US009279220B1

(12) United States Patent
Grissom et al.

(10) Patent No.: US 9,279,220 B1
(45) Date of Patent: Mar. 8, 2016

(54) ADJUSTABLE CRANE RAIL BRACE

(71) Applicant: Atlantic Track & Turnout Co., Bloomfield, NJ (US)

(72) Inventors: Jeffrey H. Grissom, West Memphis, AR (US); Aleksandr M. Killeen, Cherry Point, NC (US)

(73) Assignee: Atlantic Track & Turnout Co., Bloomfield, NJ (US)

( * ) Notice: Subject to any disclaimer, the term of this patent is extended or adjusted under 35 U.S.C. 154(b) by 112 days.

(21) Appl. No.: 14/222,179

(22) Filed: Mar. 21, 2014

(51) Int. Cl.
*E01B 9/34* (2006.01)
*E01B 9/66* (2006.01)
*B66C 7/08* (2006.01)

(52) U.S. Cl.
CPC ... *E01B 9/34* (2013.01); *B66C 7/08* (2013.01); *E01B 9/66* (2013.01); *E01B 2201/02* (2013.01)

(58) Field of Classification Search
CPC ..... E01B 9/34; E01B 9/60; E01B 9/66; E01B 9/483; E01B 2201/02; E01B 9/303; E01B 9/306; E01B 9/32; E01B 9/30; E01B 9/48; B66C 7/08
USPC ..... 238/349, 351
See application file for complete search history.

(56) References Cited

U.S. PATENT DOCUMENTS 2,250,891 A * 7/1941 Martin ..... E01B 9/60 238/292
2,356,080 A * 8/1944 Nordberg ..... E01B 9/60 238/292
2,421,992 A * 6/1947 Chance ..... E01B 9/66 238/206
2,524,586 A * 10/1950 Arnold ..... E01B 9/60 238/292
3,910,493 A 10/1975 Wood
4,566,630 A * 1/1986 Keiper, Jr. ..... E01B 9/60 238/292
4,770,342 A * 9/1988 Farrell ..... E01B 9/483 238/292
4,889,282 A * 12/1989 Marchant ..... E01B 9/32 238/331
2004/0056109 A1* 3/2004 Weaver ..... E01B 9/60 238/292

FOREIGN PATENT DOCUMENTS

EP 0272874 B1 6/1988

OTHER PUBLICATIONS

Pandrol USA LP, "'e' Clip", www.pandrolusa.com/pdf/brochures/eClip.pdf (Sep. 2013) 2 pages (Pandrol USA LP, Bridgeport, New Jersey, USA).
Pandrol USA LP, "Weld-On Shoulders", www.pandrolusa.com/pdf/brochures/weldOnShoulder.pdf (Sep. 2013) 2 pages (Pandrol USA LP, Bridgeport, New Jersey, USA).
Pandrol USA LP, "Safelok I", www.pandrolusa.com/pdf/brochures/safelokl.pdf (Sep. 2013) 2 pages (Pandrol USA LP, Bridgeport, New Jersey, USA).
Pandrol USA LP, "Safelok Spring Clips—Installation Instructions", www.pandrolusa.com/pdf/guidelines/SAFELOK.pdf (Mar. 2011) 6 pages (Pandrol USA LP, Bridgeport, New Jersey, USA).

* cited by examiner

*Primary Examiner* — Mark Le
(74) *Attorney, Agent, or Firm* — Walker, McKenzie & Walker, P.C.

(57) ABSTRACT

An adjustable crane rail brace that provides for lateral movement of a crane rail having a rail base resting upon a tie plate. The brace includes a block mounted to the tie plate and a wedge interposed between the block and the rail base. The wedge is slidable longitudinally with respect to the rail base. The block is mounted at an acute angle with respect to the lateral edge of the rail base, and the wedge has sides at this acute angle with respect to each other. The wedge also has a first serrated portion. The brace includes a member having a top face and having a second serrated portion. The first and second serrated portions are in frictional engagement, and the member has a resilient nose extending downwardly in contact with the rail base. The brace further has a spring for exerting downward force upon the top face.

3 Claims, 7 Drawing Sheets

Fig. 1
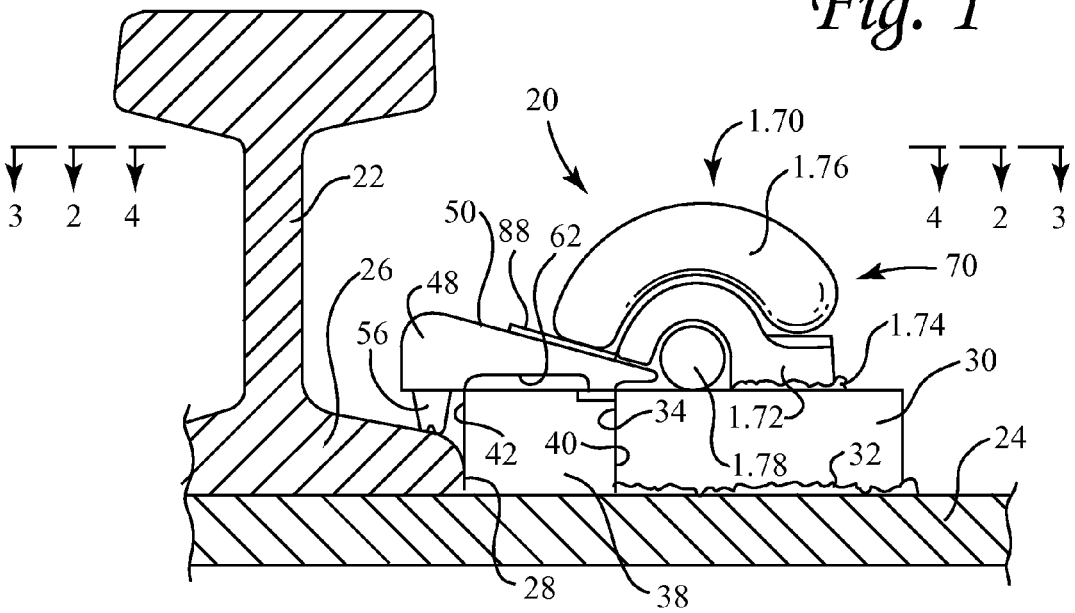
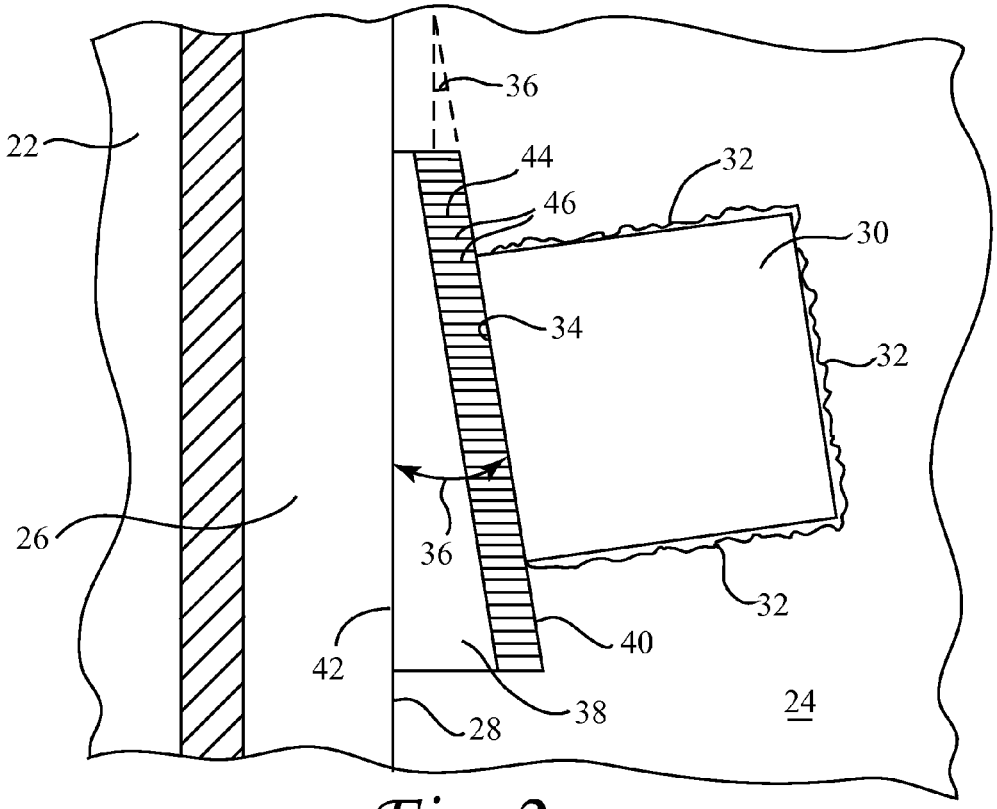
Fig. 2

Fig. 7
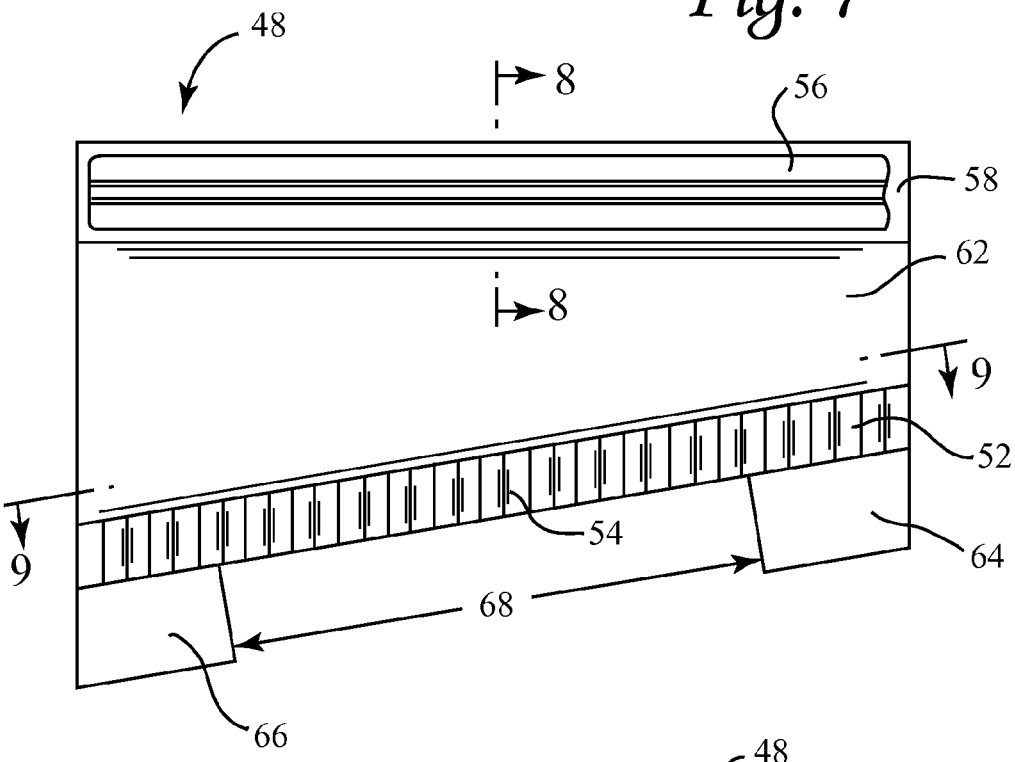
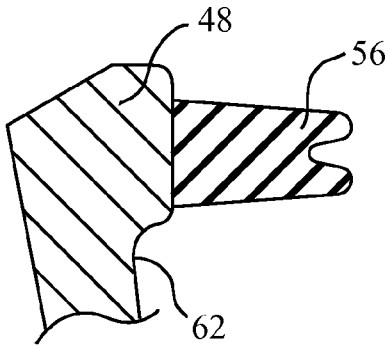
Fig. 8
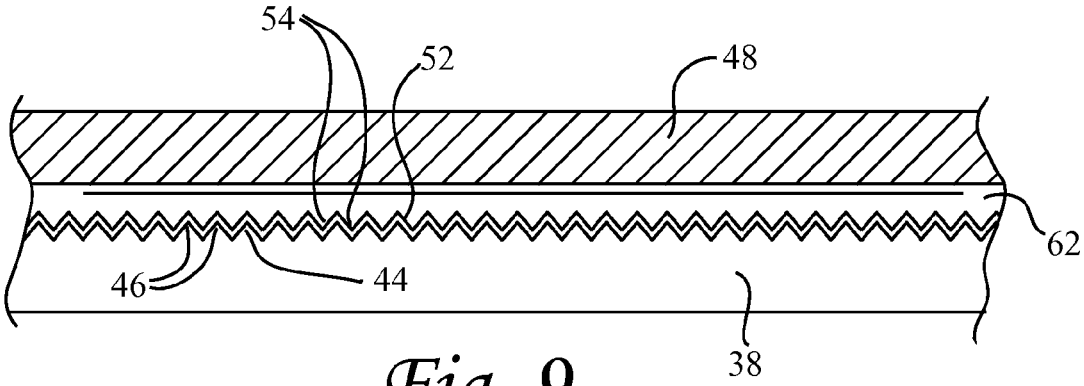
Fig. 9

Fig. 15
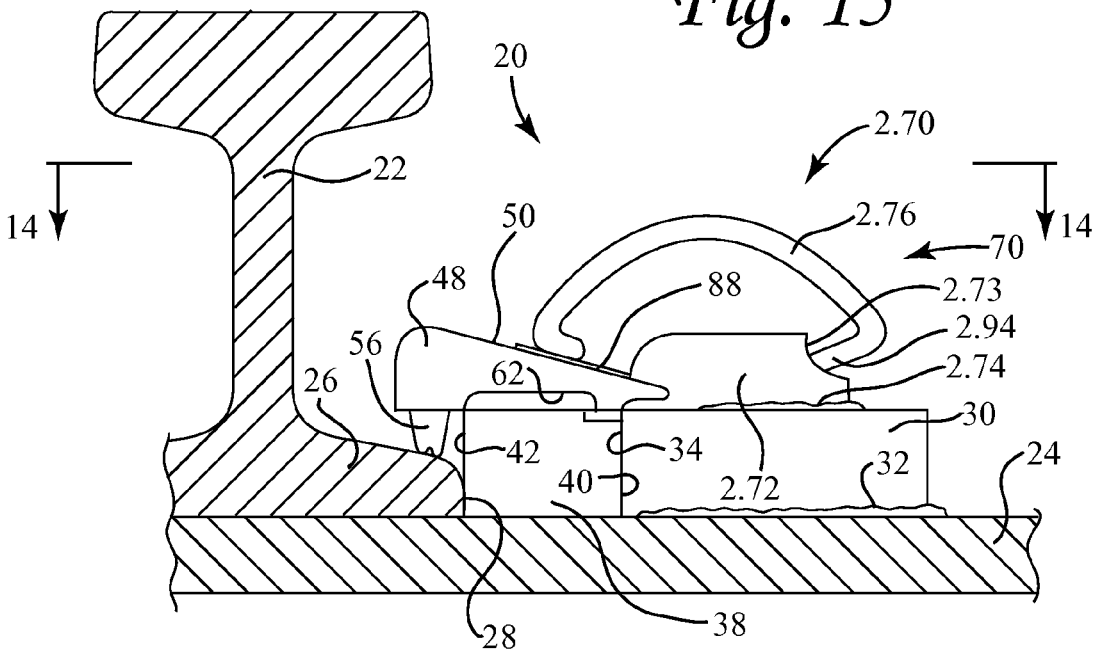
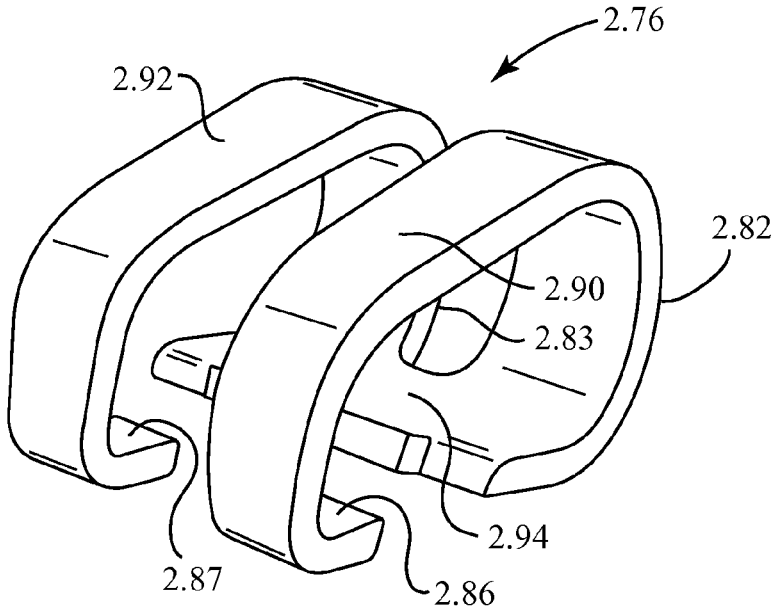
Fig. 16
(PRIOR ART)

ADJUSTABLE CRANE RAIL BRACE

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO COMPACT DISC(S)

Not applicable.

BACKGROUND OF THE INVENTION

1. Field of the Invention

The present invention relates, in general, to devices used to secure a crane rail to a rail support surface, and in particular, to an adjustable crane rail brace for securing a crane rail to a rail support surface such as a tie plate.

2. Information Disclosure Statement

It is often desired to secure a crane rail to a rail support surface. Well-known solutions for this problem include the cantilevered rail clip assembly disclosed in Marchant, European Patent EP 0 272 874 B1 (issued Apr. 10, 1991). Such prior art rail clip assemblies have a bolt extending through a cantilevered plate that has a rubber nose grip between the cantilevered plate and the lower flange of a crane rail. As the bolt is tightened, the rubber nose grip becomes compressed and secures the lower flange of the crane rail. However, such a prior art rail clip requires frequent inspection and maintenance because the threaded bolt becomes loose, thereby causing the crane rail to become unsecured and loose. If frequent inspection and maintenance is not performed, an unsafe condition can develop due to the looseness of the crane rail. This need for frequent inspection and maintenance is costly and, if the inspection and maintenance is not carefully done, accidents can result.

It is therefore desirable to have an improved crane rail brace that does not use bolts to secure a cantilevered securing plate to hold a crane rail in place.

The inventors are aware of Keiper, Jr., U.S. Pat. No. 4,566,630 (issued Jan. 28, 1986), for a Boltless, Friction-Fit, Adjustable Rail Brace, which uses a Pandrol spring clip ("e" Clip) and Pandrol weld-on shoulder that are also used in the present invention. However, unlike the present invention, the Keiper, Jr., disclosure teaches that the spring clip should exert lateral forces against the neck of the rail, whereas the present invention exerts lateral force only against the base of the rail.

None of these references, either singly or in combination, discloses or suggests the present invention.

BRIEF SUMMARY OF THE INVENTION

The present invention is an adjustable crane rail brace that provides for lateral movement of a crane rail upon a tie plate. The crane rail has a rail base resting on the tie plate, and the rail base has a lateral edge adjacent the tie plate. The brace includes a block fixedly mounted to the tie plate and a wedge interposed between the block and the rail base, with the wedge being slidable longitudinally with respect to the rail base. The block is mounted at an acute angle with respect to the lateral edge of the rail base, and the wedge has first and second sides at this acute angle with respect to each other. The wedge also has a first serrated portion with a first plurality of upwardly-facing teeth. The brace further includes a member having a top face and having a second serrated portion with a second plurality of downwardly-facing teeth. The first and second serrated portions are in frictional engagement, and the member has a resilient nose extending downwardly therefrom in contact with the rail base. The brace further has spring means, mounted to the block, for exerting downward force upon the top face. Two exemplary variants of the spring means are disclosed.

It is an object of the present invention to improved crane rail brace that does not use bolts to secure a cantilevered securing plate to hold a crane rail in place, which has lower maintenance than prior art crane rail braces and clips, and which reduces the inspections required by prior art crane rail braces and clips.

BRIEF DESCRIPTION OF THE SEVERAL VIEWS OF THE DRAWING

FIG. 1 is a transverse elevational view of a crane rail secured by the brace of the present invention and showing the first embodiment of the spring means.

FIG. 2 is a top plan view of the crane rail brace of the present invention with the spring means and the member removed to show hidden detail, taken substantially along the line 2-2 shown in FIG. 1.

FIG. 7 is a view of the underside of the member of the brace.

FIG. 8 is a sectional view of the nose of the member, taken substantially along the line 8-8 shown in FIG. 7.

FIG. 9 is an partial sectional view showing the engagement of the first and second serrated portions, taken substantially along the line 9-9 shown in FIG. 7 with the member atop the wedge.

FIG. 15 is a transverse elevational view of a crane rail secured by the brace of the present invention, similar to FIG. 1 but showing the second embodiment of the spring means.

FIG. 16 is a perspective view of the prior art spring clip of the second embodiment of the spring means.

DETAILED DESCRIPTION OF THE INVENTION

Figure 3:
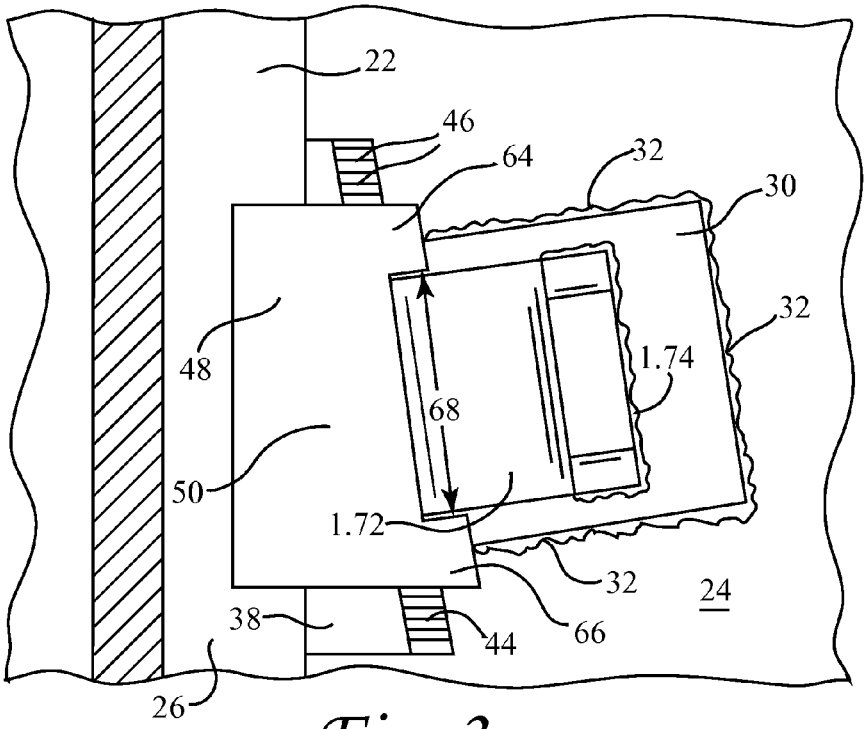
FIG. 3 is a top plan view of the crane rail brace of the present invention, similar to FIG. 2 but with the addition of the brace's member and the spring mounting of the first embodiment of the spring means, taken substantially along the line 3-3 shown in FIG. 1.
Figure 4:
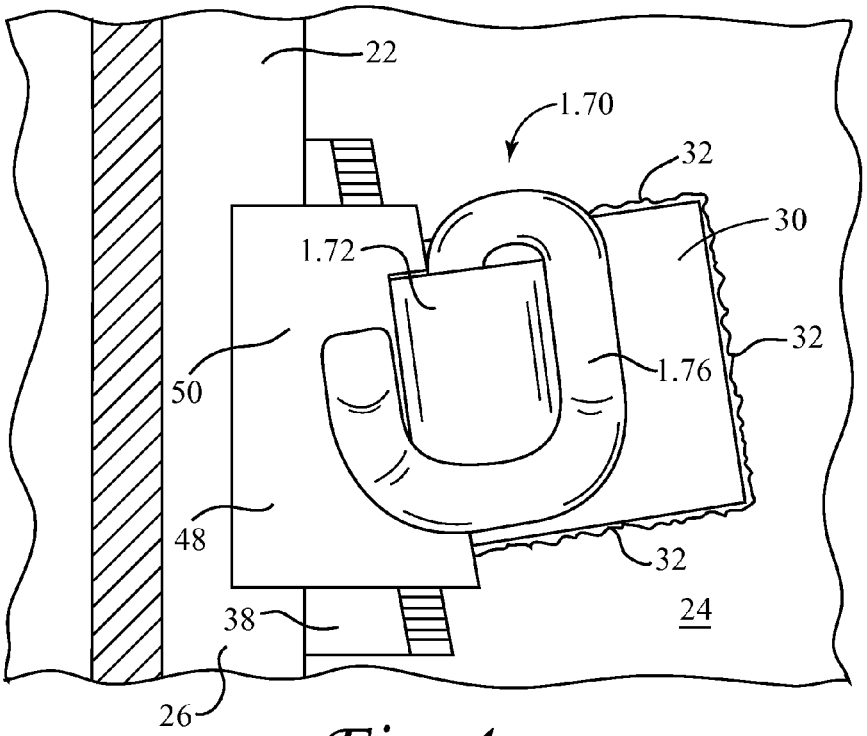
FIG. 4 is a top plan view of the crane rail brace of the present invention, similar to FIG. 3 but with the addition of the spring clip of the first embodiment of the spring means, taken substantially along the line 4-4 shown in FIG. 1.
Figure 5:
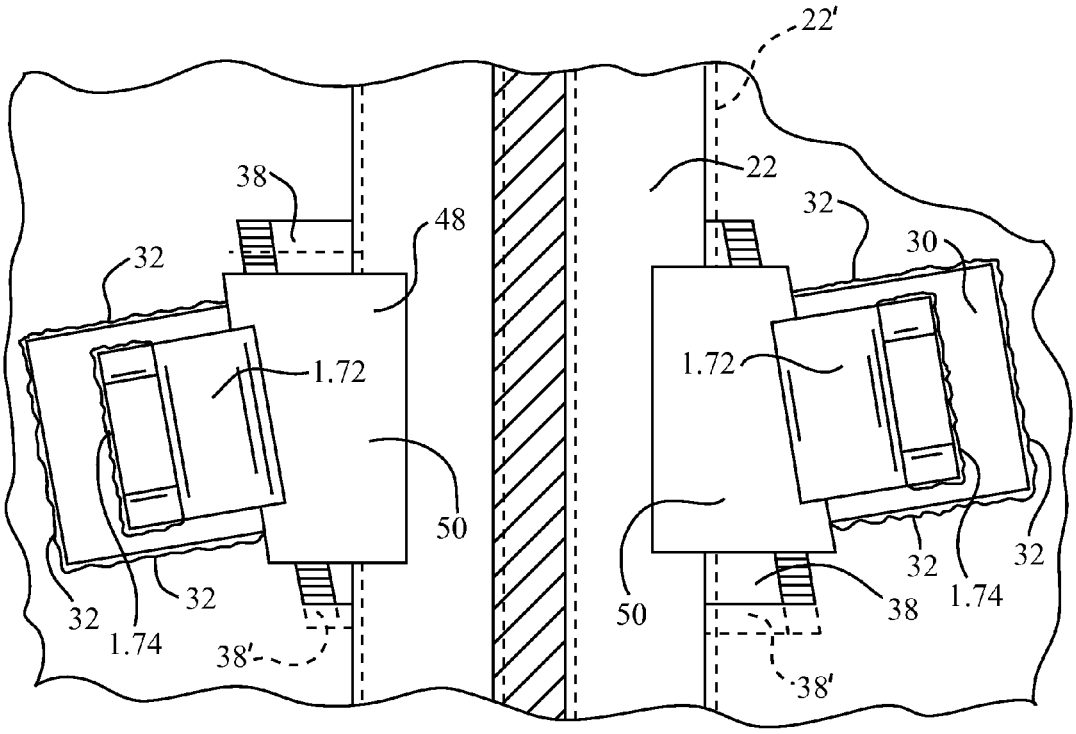
FIG. 5 is a top plan view of a pair of crane rail braces, one on either side of the crane rail, showing longitudinal movement of the wedges to cause lateral movement of the crane rail. The spring clip of the first embodiment of the spring means is removed to show detail.
Figure 6:
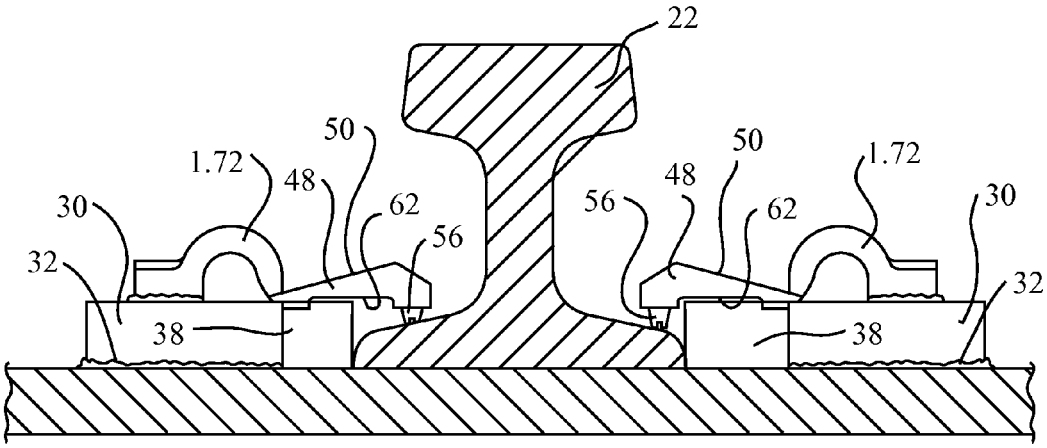
FIG. 6 is a transverse elevational view of the pair of crane rail braces of FIG. 5.

Referring to FIGS. 1-12, the adjustable brace 20 of the present invention is for bracing a well-known crane rail 22 on a rail support surface such as a well-known tie plate 24. Crane rail 22 has a rail base 26 that rests on tie plate 24, and rail base 26 has a lateral edge 28 adjacent tie plate 24.

Adjustable brace 20 includes a block 30 fixedly mounted to tie plate 24 as by welds 32. Block 30 has a first face 34 at an acute angle 36, preferably between about 11 and 12 degrees. Adjustable brace 20 also includes a wedge 38 interposed between first face 34 and rail base 26, and the wedge 38 is slidable longitudinally parallel with respect to lateral edge 28 of rail base 26. Wedge 38 has first and second sides 40, 42 that are at acute angle 36 with respect to each other, and wedge 38 has a first serrated portion 44 that has a first plurality of upwardly-facing teeth 46.

Adjustable brace 20 further includes a member 48 that has a top face 50. Member 48 also has a second serrated portion 52 that has a second plurality of downwardly-facing teeth 54. The angle and pitch of teeth 54 should match the angle and pitch of teeth 46, thus causing first and second serrated portions 44, 52 to be adapted for frictional mating engagement as best seen in FIG. 9. Member 48 also has a resilient nose 56, preferably of nitrile rubber or a similar elastomeric material and glued to a flat portion 58 of the underside 60 of member 48 remote from second serrated portion 52, with nose 56 extending downwardly from the member 48 and in contact with rail base 26, as best seen in FIG. 1. An acceptable supplier for the rubber used in nose 56 is Atlantic Track Crane Runway Division, 1001 James Drive, Suite B37, Leesport Pa. 19533, U.S.A., from whom the rubber material can be purchased in lengths of 1.2 meters, with thicknesses varying from 8 mm to 22 mm. The underside 60 of member 48 preferably has a channel 62 between nose 56 and second serrated portion 52, and member 48 also has first and second spaced-apart ears 64, 66 that extend rearwardly away from crane rail 22 with a gap 68 between the ears. Channel 62 ensures that the resilient nose 56 is at the end of a lever arm formed by member 48, such that the underside of member 48 does not contact the top surface of wedge 38 except for the mating engagement of first and second serrated portions 44, 52. The mating engagement of first and second serrated portions 44, 52 is seen to lock the position of wedge 38 with respect to member 48, thereby fixing the lateral position of crane rail 22.

Adjustable brace 20 further includes spring means 70, mounted to block 30, for exerting downward force upon top face 50 of member 48. Two exemplary embodiments, 1.70 and 2.70, with slightly different structure, are provided that perform the same function of exerting downward force upon top face 50 of member 48.

Figure 10:
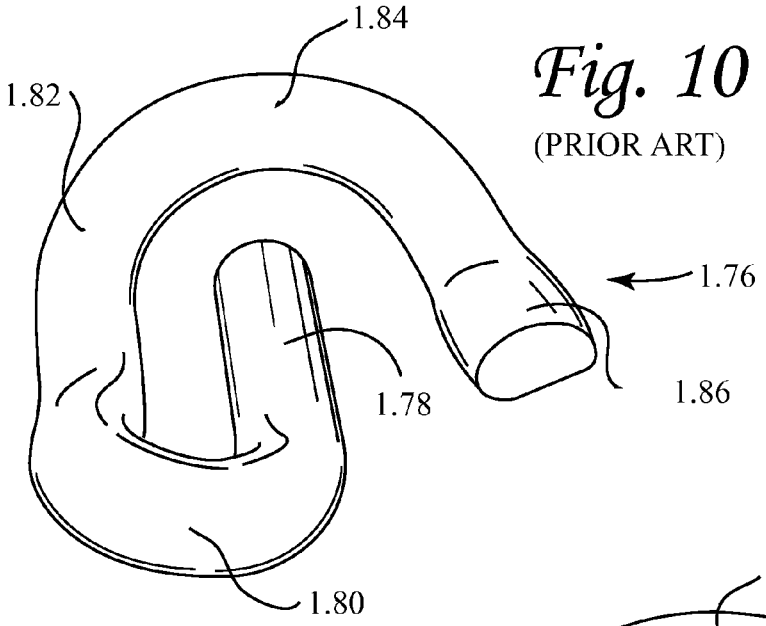
Fig. 10 (PRIOR ART)
FIG. 10 is a perspective view of the prior art spring clip of the first embodiment of the spring means.
Figure 11:
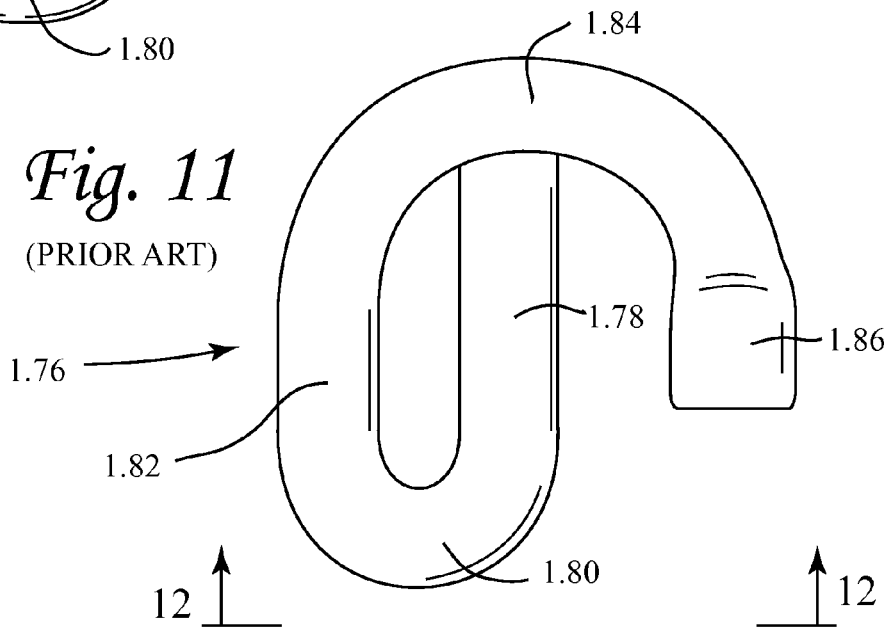
Fig. 11 (PRIOR ART)
FIG. 11 is a top view of the prior art spring clip of the first embodiment of the spring means.
Figure 12:
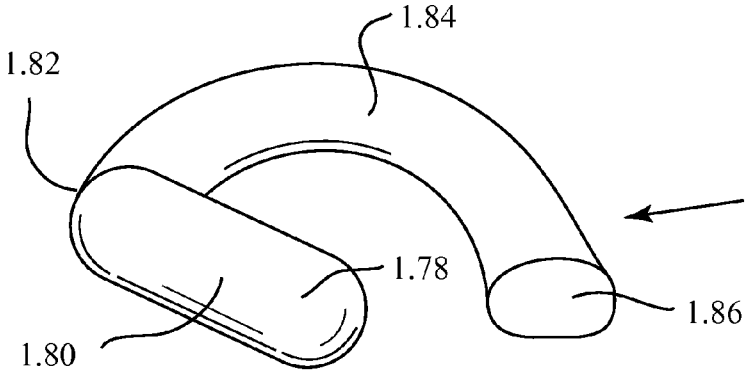
Fig. 12 (PRIOR ART)
FIG. 12 is an end view of the prior art spring clip of the first embodiment of the spring means, taken substantially along the line 12-12 shown in FIG. 11.

The first embodiment 1.70 of spring means 70 includes a spring mounting 1.72 fixedly attached to block 30 as by welds 1.74, and further includes a removable spring clip 1.76 that is inserted into spring mounting 1.72. A suitable spring clip for use as spring clip 1.76 is the "e" series clip sold by Pandrol, 501 Sharptown Rd., Bridgeport, N.J. 08014, U.S.A., Part Number ECL-2055 (right hand) and ECL-2056 (left hand), having a nominal "toe load" of 2,750 lbs, a working deflection of 7/16 inches, and a nominal rail seat claiming force of 5,500 lbs. This prior art "e" clip is shown in FIGS. 10, 11, and 12, and has a center leg 1.78, a rear arch 1.80, a heel 1.82, a front arch 1.84, and a toe 1.86. A suitable spring mounting 1.72 for use with spring clip 1.76 is the forged steel weld-on shoulder sold by Pandrol, 501 Sharptown Rd., Bridgeport, N.J. 08014, U.S.A., model SHL-7299-1. Spring mounting 1.72 is fixedly attached to block 30 as by welds 1.74, with ears 64, 66 engaging spring mounting 1.72 in gap 68 so as to prevent movement of member 48. A low-friction pad or washer 88 may be provided under toe 1.86 on the top face 50 of member 48 for insulation and to make it easier to insert spring clip 1.76 into mounting 1.72 as hereinafter described.

When the brace has been partially assembled as shown in FIG. 3, spring clip 1.76 is forcibly inserted into mounting 1.72 as by using a sledgehammer, entrapping center leg 1.78 under spring mounting 1.72. Once the brace has been assembled, a sledgehammer can be used to hit the ends of wedge 38, causing wedge 38 to move to a moved position 38' (see FIG. 5), thereby causing rail 22 to shift laterally to a moved position 22' (again, see FIG. 5). Note that the wedges on opposite sides of rail 22 move in the same direction (both upstream or both downstream) so as to cause rail 22 to shift.

Referring now to FIGS. 13-16, the second embodiment 2.70 of spring means 70 will now be disclosed. There are many similarities between the two embodiments of spring means 70, and only the differences between the embodiments will be discussed in detail, it being understood that similar structure for the various embodiments serves similar purpose. The reference numerals for the various parts of the first and second embodiments of spring means 70 shall be understood to have a prefix identifying the particular embodiment (e.g., "1.", "2.") and a suffix identifying the particular structure (e.g., "70", etc.), such that reference numerals with the same suffix are understood to be similar structure particular to the different embodiments of spring means 70 (e.g., "1.70", "2.70"). The variation in the embodiments of spring means 70 is the only difference between the two versions of the adjustable brace of the present invention.

The second embodiment 2.70 of spring means 70 includes a spring mounting 2.72 fixedly attached to block 30 as by welds 2.74, and further includes a removable spring clip 2.76 that is inserted into spring mounting 2.72. A suitable spring clip for use as spring clip 2.76 is the "SAFELOK I" series clip fastener sold by Pandrol, 501 Sharptown Rd., Bridgeport, N.J. 08014, U.S.A., model SCL-36800, having a nominal "toe load" of 4,800 lbs. This prior art spring clip is shown in FIG. 16, and has left and right legs 2.90, 2.92, left and right heels 2.82, 2.83, a blade 2.94, and left and right toes 2.86, 2.87. A suitable spring mounting 2.72 for use with spring clip 2.76 is the cast steel weld-on shoulder sold by Pandrol, 501 Sharptown Rd., Bridgeport, N.J. 08014, U.S.A., model 38450. Spring mounting 2.72 is fixedly attached to block 30 as by welds 2.74, with ears 64, 66 engaging spring mounting 2.72 in gap 68 so as to prevent movement of member 48. A low-friction pad or washer 88 may be provided under toe 2.86 on the top face 50 of member 48 for insulation and to make it easier to insert spring clip 2.76 into mounting 2.72 as hereinafter described.

Figure 13:
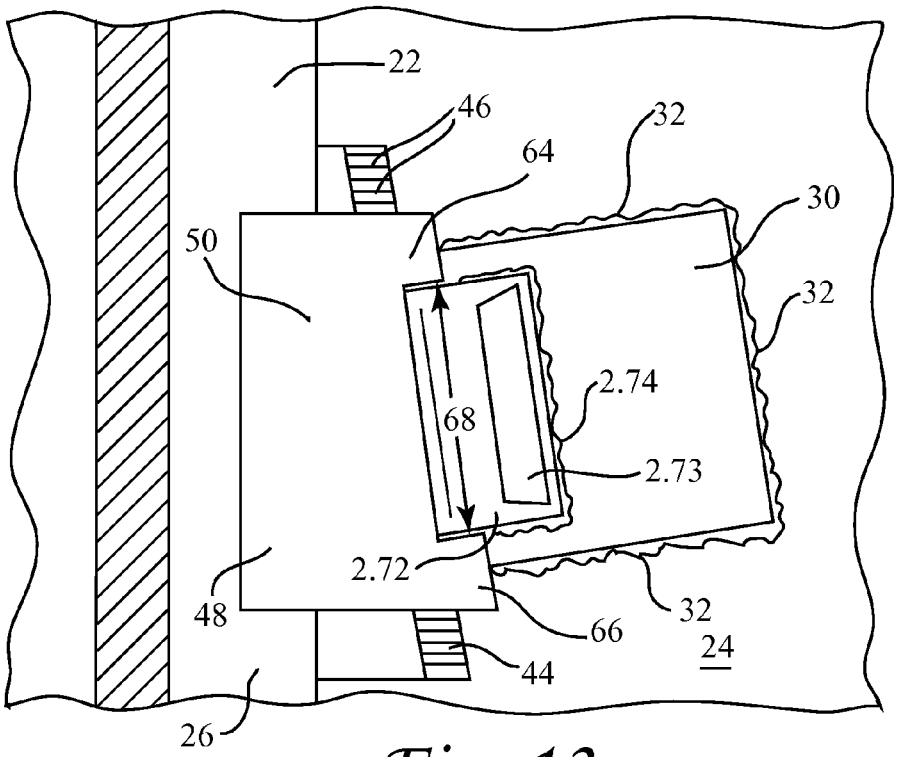
FIG. 13 is a top plan view of the crane rail brace of the present invention, similar to FIG. 3 but instead showing the spring mounting of the second embodiment of the spring means.
Figure 14:
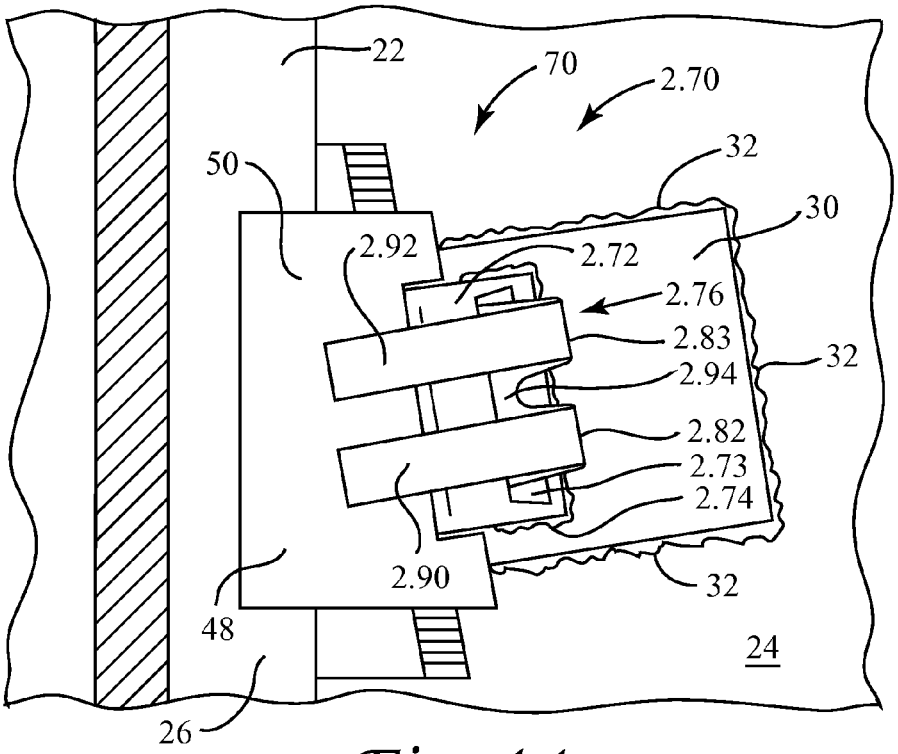
FIG. 14 is a top plan view of the crane rail brace of the present invention, similar to FIG. 4 but instead showing the spring mounting and the spring clip of the second embodiment of the spring means, taken substantially along the line 14-14 shown in FIG. 15.

When the brace has been partially assembled as shown in FIG. 13, blade 2.94 of spring clip 2.76 is forcibly inserted into a rearward-facing cavity 2.73 of mounting 2.72 as by using a sledgehammer against the heels 2.82, 2.83. As with the first embodiment of the spring means, once the brace has been assembled, a sledgehammer can be used to hit the ends of wedge 38, causing wedge 38 to move, thereby causing rail 22 to shift laterally in the same manner as previously described with the first embodiment.

Except for nose 56 and pad/washer 88, all parts are preferably of forged or cast steel for durability.

INDUSTRIAL APPLICABILITY

The present invention is an adjustable crane rail brace for securing a crane rail to a rail support surface such as a tie plate without bolts, and provides for lateral adjustment of the crane rail.

Although the present invention has been described and illustrated with respect to a preferred embodiment and a preferred use therefor, it is not to be so limited since modifications and changes can be made therein which are within the full intended scope of the invention.

We claim:

1. An adjustable brace for bracing a crane rail on a tie plate, said crane rail having a rail base resting on said tie plate, said rail base having a lateral edge adjacent said tie plate; said brace comprising:

(a) a block fixedly mounted to said tie plate, said block having a first face at an acute angle with respect to said lateral edge of said rail base;

(b) a wedge interposed between said first face of said block and said rail base, said wedge being slidable longitudinally with respect to said lateral edge of said rail base, said wedge having first and second sides, said first and second sides being at said acute angle with respect to each other, said wedge having a first serrated portion having a first plurality of upwardly-facing teeth;

(c) a member, said member having a top face and having a second serrated portion having a second plurality of downwardly-facing teeth, said first and said second serrated portions being in frictional mating engagement, said member having a resilient nose extending downwardly therefrom in contact with said rail base; and (d) spring means, mounted to said block, for exerting downward force upon said top face.

2. The adjustable brace as recited in claim 1, in which said brace is boltless.

3. The adjustable brace as recited in claim 1, in which said spring means comprises:

(a) a spring mounting fixedly attached to said block; and (b) a removable spring clip inserted into said spring mounting and exerting said downward force upon said top face.

* * * * *